US005085157A

United States Patent [19]

Jung et al.

[11] Patent Number: 5,085,157

[45] Date of Patent: Feb. 4, 1992

[54] SEWING MACHINE WITH AN ADJUSTABLE CUTTING DEVICE

[75] Inventors: Detlef Jung; Gerhard Riss, both of Bielefeld; Heinz Niehaus, Enger, all of Fed. Rep. of Germany

Dürk Opp Adler Aktiengesellschaft, Fed. Rep. of Germany

[21] Appl. No.: 581,033

[22] Filed: Sep. 12, 1990

[30] Foreign Application Priority Data

Sep. 13, 1989 [DE] Fed. Rep. of Germany ..... 3930562

[51] Int. Cl.[5] ..... D05B 3/06

[52] U.S. Cl. ..... 112/68; 112/264.1

[58] Field of Search ..... 112/68, 221, 129, 130, 112/264.1, 235

[56] References Cited

U.S. PATENT DOCUMENTS

| | | | |
|---|---|---|---|
| 2,402,251 | 6/1946 | Johnson | 112/221 X |
| 3,089,447 | 5/1963 | Shuman | 112/235 |
| 3,495,560 | 2/1970 | Walling | 112/235 |
| 3,847,097 | 11/1974 | Dusch et al. | 112/68 |
| 3,913,508 | 10/1975 | Boser | 112/221 |
| 4,630,557 | 12/1986 | Russell | 112/235 |
| 4,981,094 | 1/1991 | Stapel et al. | 112/235 |

FOREIGN PATENT DOCUMENTS

GM7634151 10/1976 Fed. Rep. of Germany .

*Primary Examiner*—Werner H. Schroeder
*Assistant Examiner*—Paul C. Lewis
*Attorney, Agent, or Firm*—Ostrolenk, Faber, Gerb & Soffen

[57] ABSTRACT

A knife which is moveable vertically by a mover cooperates during the cutting process with a cutting plate which is mounted in a throat plate. A cutting edge of the knife is aligned parallel to an upper edge of the cutting plate so that these two cutting bodies momentarily contact each other over the full surface. In order to achieve a predetermined depth of penetration of the cutting edge into the cutting plate, which is made of visco-elastic plastic, the knife is first brought into an upper position by the mover. Then it is adjusted by a displacement member mounted in the mover. Its vertical position with respect to the cutting plate is displaced by a desired amount, while maintaining the parallel relationship of the cutting edge and the upper edge, regardless of their instantaneous position.

14 Claims, 4 Drawing Sheets

SEWING MACHINE WITH AN ADJUSTABLE CUTTING DEVICE

BACKGROUND OF THE INVENTION

The present invention relates to a sewing machine having a cutting device for producing a cut such as a buttonhole in a workpiece. This type of cutting device generally comprises a mover fastened to the arm head of the sewing machine, which moves a rod vertically against the action of a compression spring. A block is attached to the lower end of the rod. A knife and a cutting plate cooperate to perform the cutting, either the cutting plate or the knife being fastened via a holder to the block A buttonhole cutting device of this general type is known from German Utility Model No. 76 34 151. In accordance therewith, a stationary knife cooperates during the cutting process with a cutting plate which is moveable vertically upward and downward and consists of visco-elastic plastic. The knife is arranged adjustably and replaceably below a throat plate in a block which is mounted in the machine housing The cutting plate which acts as abutment is received by a holder which is fastened in displaceable position on a block. The latter is fastened on a vertically moveable rod which is part of a mover which is mounted on an arm head of a sewing machine. In order to effect a dependable cut, the cutting plate is moved in the direction towards the knife in such a manner that their facing active cutting edges temporarily contact each other over the full length in the horizontal plane and then—at the end of the cutting process—one cutting edge of the knife penetrates by a predetermined amount of about 0.3 to 0.5 mm into the cutting plate. In order to satisfy the requirements which have just been described, the rod which receives the block is brought into its low position. In this position, the cutting plate is so directed relative to the horizontally extending cutting edge of the knife as to assure a flat full-surface resting of an upper edge of the cutting plate with respect to the cutting edge of the knife. Thereupon the rod and, with it, the cutting plate, is brought into its upper position and the resulting distance between the upper edge of the cutting plate and the cutting edge of the knife is determined. Based on this distance measurement, the cutting plate which is aligned towards the knife is subsequently displaced by the aforementioned amount in the direction towards the knife so that the cutting edge of the knife can penetrate into the cutting plate by the aforementioned amount when the cutting plate again descends.

By the subsequent displacement of the cutting plate, its previously assumed flat alignment with respect to the cutting edge of the knife is again lost, since the two adjustment processes just described, which are to be effected independently of each other, mutually affect each other. Thus the known cutting device has the disadvantage that the prerequisites required for a dependable cut—namely temporary flat contact of the two active cutting edges, as well as the maintaining of a prescribed depth of penetration of the cutting edge of the knife into the cutting plate—can be satisfied only by a large number of time-consuming adjustment processes.

SUMMARY OF THE INVENTION

The object of the invention is, therefore, to further develop a cutting device of this type so that the moveable cutting body can be easily and rapidly adjusted with respect to the stationary cutting body.

This object is achieved in a cutting device according to this invention, wherein the moveable cutting body, which in the preferred embodiment is a knife held in the block, is secured against rotation by guide means, and the block is attached in both force-locked and form-locked manner to the vertically-extending rod. By loosening the force-locked connection between the rod and the block, the rod is free to be rotated about its axis by a displacement member which is mounted in the mover, and this rotation of the rod causes the block to move axially of the rod.

According to a preferred embodiment of the invention, a cylindrical extension and a threaded pin are provided on the lower end of the rod. Surrounding these, the block has a clamping bore and a threaded hole, respectively, which are separated from each other in part by a slot which extends transverse to the rod. The guide means is formed by a guide ledge provided on the block and a corresponding guide slot which is fastened to the frame. By means of the threaded pin of the rod and the threaded hole in the block, rotation of the rod causes the block to move axially of the rod.

The invention enables the position of the moveable cutting body to be adjusted vertically in an advantageous fashion, in which the preadjusted parallel relationship of the cutting edge of the knife and the upper edge of the cutting plate is retained, regardless of the instantaneous position of the two parts. In this way, flat, full-surface contact of the active cutting edges of both cutting bodies is assured, even after displacement of the moveable cutting body.

According to other advantageous features of the invention, the mover is preferably a double-acting pressure cylinder having a piston to which the rod is firmly attached. Two pin stops are provided in the piston and extend into a milling in the piston The pressure may be pneumatic, hydraulic, or the like. The displacement member is rotatable within an upper cover of the mover and manually operable from the outside. A flange provided on the displacement member has two recesses into which the pin stops at least momentarily engage, for providing operating engagement between the displacement member and the rod, via the piston.

Other features and advantages of the present invention will become apparent from the following description of an embodiment of the invention, with reference to the accompanying drawings.

BRIEF DESCRIPTION OF THE DRAWINGS

One embodiment of the invention will be explained on the basis of FIGS. 1 to 7 of the drawings, in which.

DETAILED DESCRIPTION OF THE DRAWINGS

Figure 1:
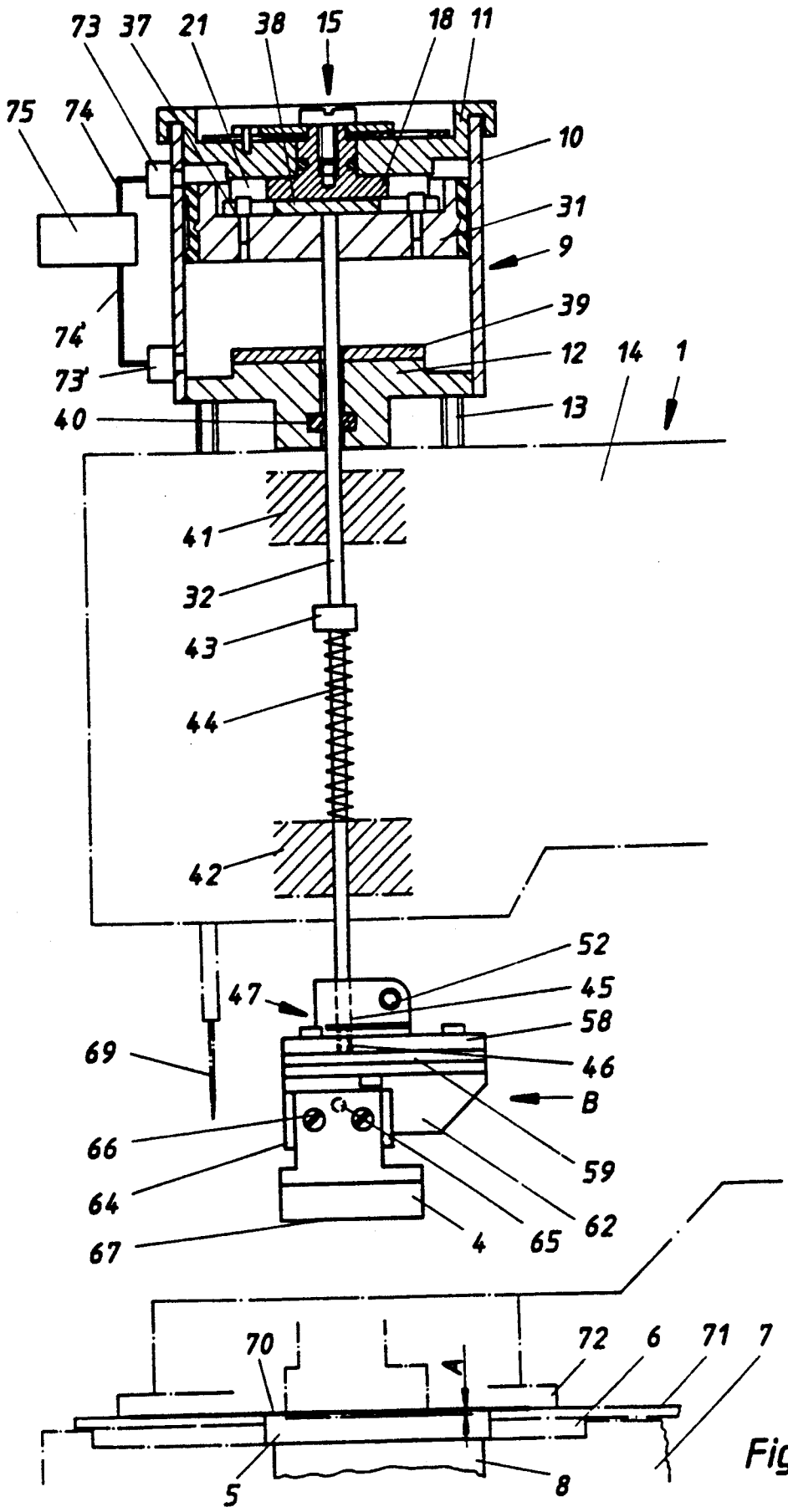
FIG. 1 is a simplified diagrammatic view of the cutting device.
Figure 4:
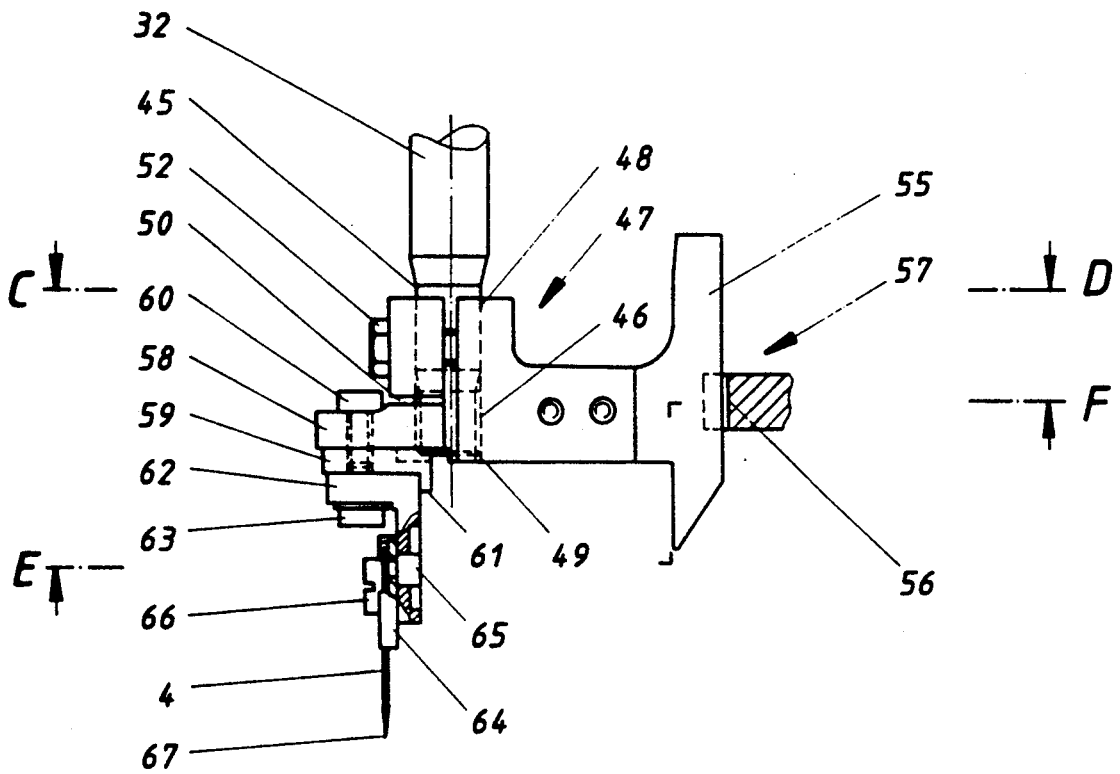
FIG. 4 is a side view taken in the direction B indicated in FIG. 1.
Figure 4:
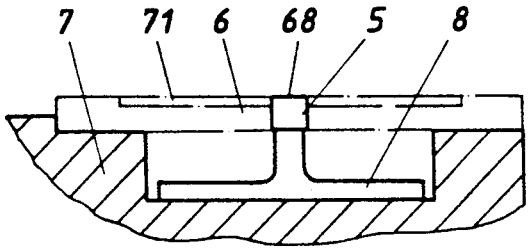
Figure 7:
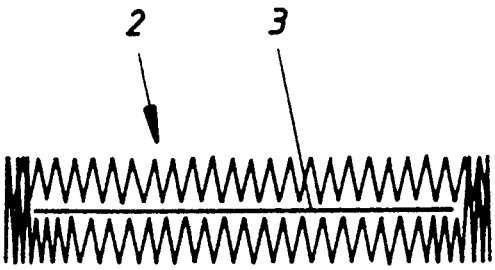
FIG. 7 is a top view of a buttonhole provided with a cut.

FIG. 1 shows diagrammatically a sewing machine 1 for sewing a buttonhole 2 (FIG. 7), the machine being provided with a cutting device, for making a cut 3 in the sewn buttonhole 2. In this sewing machine, a moveable cutting body cooperates with a stationary cutting body, both being parts of the cutting device, the moveable cutting body being embodied in the present case by a vertically moveable knife 4 and the stationary cutting body by a cutting plate 5. The latter is made of a visco-elastic plastic and is received by a throat plate 6, as indicated in FIGS. 1 and 4. An abutment 8 which is fixed with respect to the frame and fastened to a foundation plate 7 supports the cutting plate 5 from below.

One essential component of the cutting device is a mover which is actuated by external force and is embodied by a double-acting compressed-air or hydraulic cylinder. The mover 9 comprises a cylindrical tube 10 which is closed by an upper cover 1 and a lower cover 12 so that the emergence of pressure fluid is prevented. The mover 9 is firmly attached to an arm head 14 of the sewing machine 1 by screws 13.

The upper cover 11, which has the shape of a bushing, receives at its axis of symmetry a rotatably mounted displacement member 15, part of which is arranged in a depression 16 in the cover 11 outside the mover 9. The displacement member 15 comprises a base body 17 which has a flange 18, a pin 19 and an extension 20. Within the flange 18, there are two diametrically opposite recesses 21. The pin 19 bears a sealing ring 22 in a groove provided on its circumference. The extension 20 is provided in order to receive a corrugated disk spring 23, as well as an adjustment disk 24, the latter being mounted, secured against rotation, on the extension 20 by suitable shaping of the extension 20, which can be square-shaped, for instance. At its top surface, directed through its center point, the adjustment disk 24 has a slot 25. A stop nose 26 furthermore is provided on the circumference of the adjustment disk 24. A corresponding stop edge of the stop nose 26 rests against a protruding holding pin 27 force-fitted in the cover 11 and thus limits the rotation of the adjustment disk 24 to less than 360°. On the top surface of the stop nose 26 a mark 28 is scratched, which is preferably colored. At the bottom of the depression 16 there is fastened, for instance by bonding, a graduated ring 29 with graduations applied on it.

Figure 2:
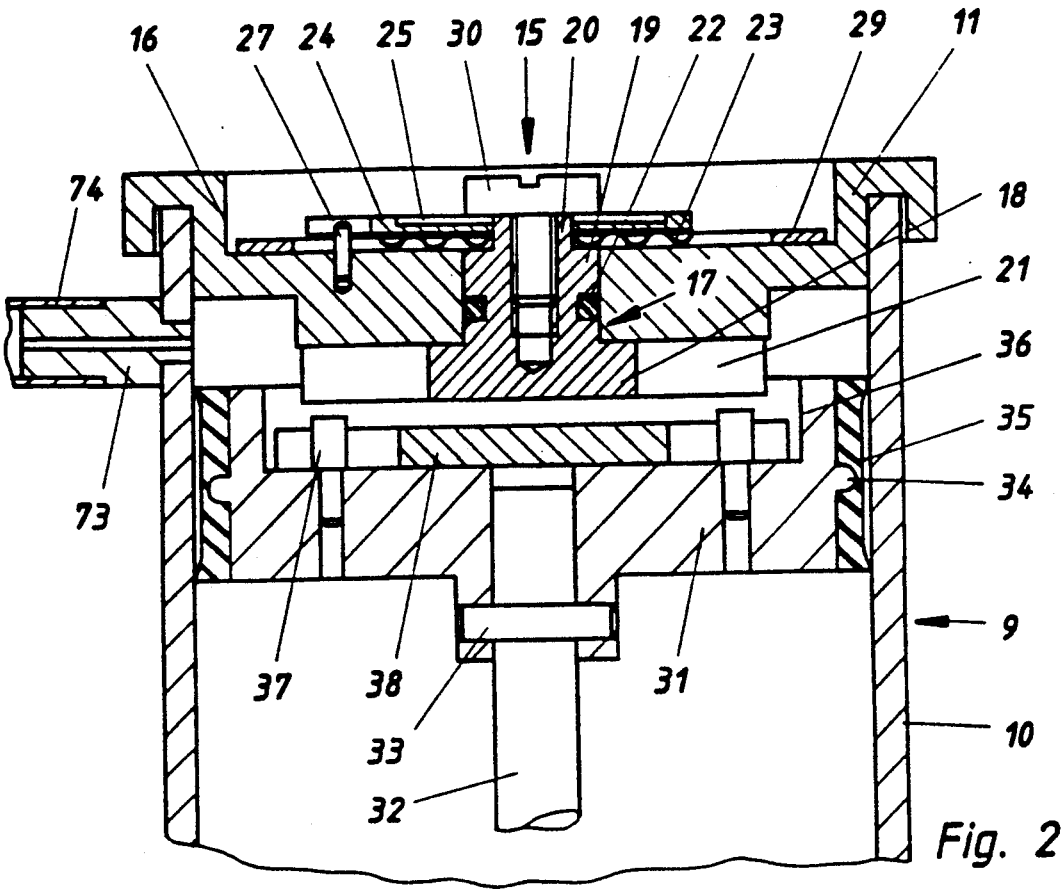
FIG. 2 is a sectional view taken through the mover, its piston being moved downward.
Figure 3:
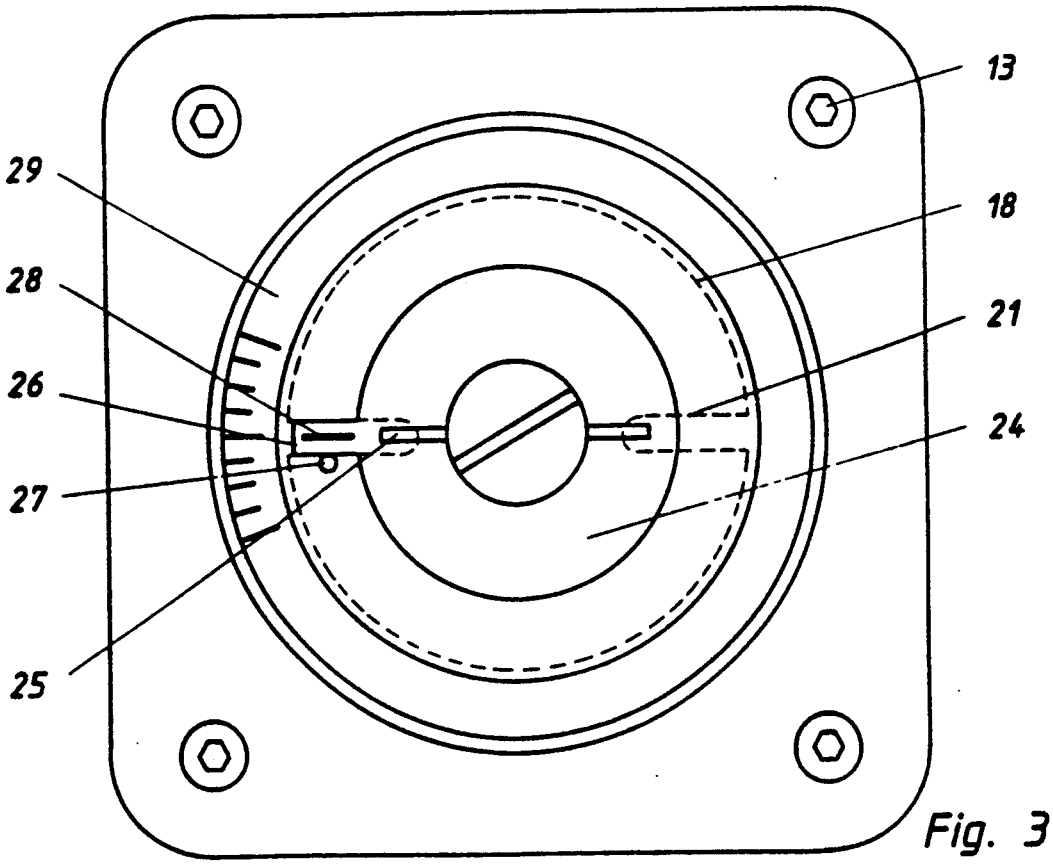
FIG. 3 is a top view of the mover.

The base body 17, the disk spring 23 and the adjustment disk 24 are connected to each other in force-locked and form-locked manner by a fastening means, for instance a screw 30, as shown in FIG. 2, so that the disk spring 23 is compressed by a predetermined amount. In this way, relatively stiff turning of the displacement member 15 is made possible, for which a special wrench is required (not shown) which has two drivers lying in alignment so that each engages the slot 25.

Within the mover 9 is a piston 31 to which a rod 32 is firmly attached by means of a pin 33. On the circumference of the piston 31 there is a rib 34 which receives an ordinary commercial sealing element 35. A cylindrical milling 36 is provided on the top of the piston 31. As shown in FIGS. 1 and 2, the piston 31 has two pin stops 37 which extend into the milling 36 and are attached firmly to the piston 31 by bonding, soldering or welding. The arrangement of the pin stops 37 makes it possible for them to engage into the recesses 21 in the flange 18, when the piston 31 is in the upper position, as shown in FIG. 1. On the bottom of the milling 36 a damping disk 38 is provided, bonded to the piston 31, for instance, in order to provide sound damping. Another damping disk 39 is provided in similar manner on the bottom of the lower cover 12. The lower cover 12 has a bore in which a sealing ring 40 is provided.

The rod 32 is received by an upper bearing bushing 41 and a lower bearing bushing 42, both of which are arranged in the arm head 14. Between the lower bearing bushing 42 and a stop 43, which is formed, for instance, by a ring firmly attached to the rod 32, is a compression spring 44. This spring assures that when no pressure is applied to the mover 9, the piston 31 is in its upper position.

Figure 6:
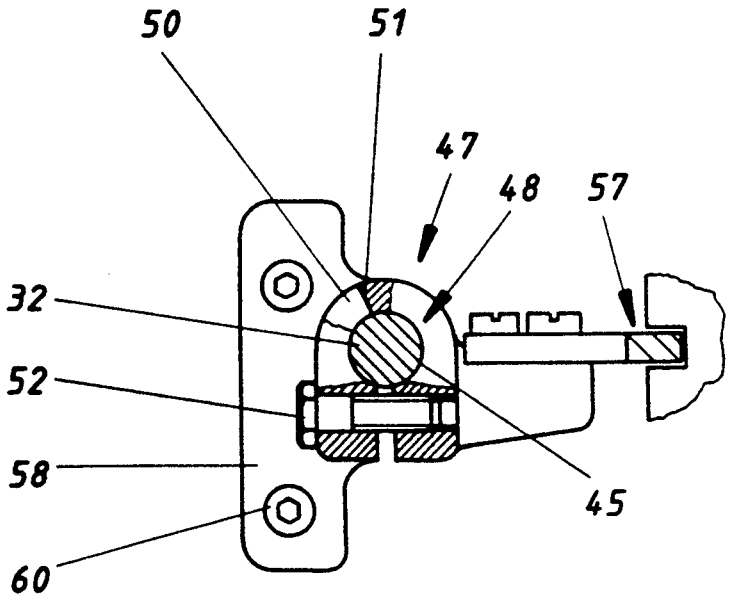
FIG. 6 is a sectional view taken along the section line C-D of FIG. 4.

On the lower end of the rod 32 which extends out of the arm head 14, there is provided, as best shown in FIGS. 1 and 4, a cylindrical extension 45, as well as a threaded tip or pin 46 which adjoins it. A block 47 is secured to the lower end of the rod 32 via the extension 45 and the threaded pin 46. For this purpose, the block 47 has, surrounding respectively the extension 45 and the threaded pin 46, a cylindrical clamping bore 48 and a threaded hole 49. The two are partially separated from each other (see FIG. 4) by a slot 50 which, in accordance with FIG. 6, has a circularly extending edge 51. The threaded hole 49 receives the threaded pin 46 and thus permits a form-locked attachment of the rod 32 to the block 47. A force-locked connection of the last-mentioned parts is produced by first tightening a screw 52 as shown in FIG. 4, and then clamping a holder 62 via the clamping bore 48 on the extension 45, as shown in FIG. 6.

On a nose 53 which is provided on the block 47 (FIG. 5) a guide strip 55 is fastened by screws 54 and is received by a guide slot 56, which is fixed with respect to the frame, arranged on the arm head 14. The guide strip 55 and the guide slot 56 represent a guide means 57, as a result of which rotational or radial movement of the block 47 is prevented. The block 47 also has a bracket 58 on the bottom of which, as shown in FIG. 4, a plate 59 is fastened by means of two screws 60. As shown in FIG. 4, the plate 59 has a slightly protruding web 61. Against the latter there rests the holder 62 (see FIGS. 4 and 5) which is attached to the plate 59 by means of another screw 63 through a slot, not shown here, provided in the holder 62.

Figure 5:
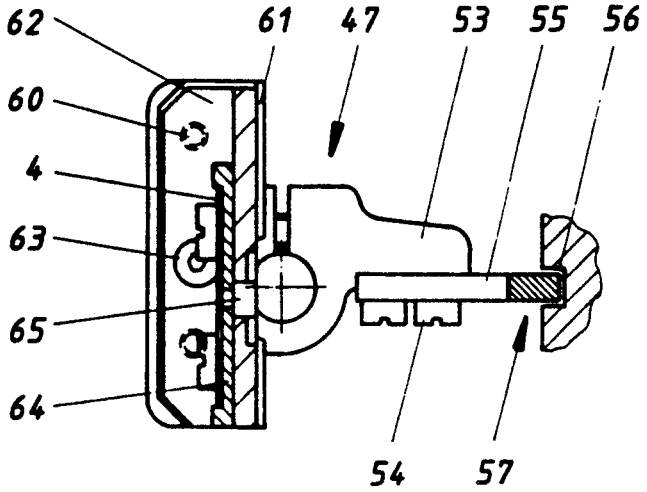
FIG. 5 is a sectional view taken along the section line E-F of FIG. 4.

A knife holder 64 has a pin 65 which is firmly connected to it and has a protruding end which is received by a hole present in the holder 62, as shown in FIG. 4. Thus, the knife holder 64 is mounted swingably on the holder 62. The knife holder 64 receives the knife 4, as shown in FIGS. 4 and 5. After tightening two attachment screws 66, the knife holder 4, and with it the knife 4, assume a well-defined position with respect to the holder 62.

By loosening the screws 60, the plate 59 can be adjusted jointly with the parts mounted thereon, namely the holder 62 and the knife holder 64, relative to the block 47, so that a cutting edge 67 of the knife 4, as shown in FIG. 4, can be placed at the center of the cutting plate 5. By loosening the attachment screws 66, the knife 4 can be adjusted by swinging it around the pin 65, which acts as a pivot, so that with the rod 32 in the low position, the cutting edge 67 contacts an upper flat surface 68 of the cutting plate 5 over its full length. By loosening the screw 63, the knife 4 can be shifted as close as possible to a sewing needle 69, during which the central position of the cutting edge 67 with respect to the cutting plate 5 is unchanged, since the holder 62 still continuously rests against the web 61.

A sewing part 70 is held between a pusher 71 and a sewing-material clamp 72, both of which are part of the sewing machine 1 and are moveable in, and opposite to, the direction of transport of the sewing material.

On the mover 9 are two ordinary commercial hose couplings 73, 73' (FIGS. 1 and 2) which permit the connecting of hoses 74, 74'. Via the latter, pressure fluid is conducted from a source of pressure fluid (not shown) into the mover 9, the start and duration of the corresponding action being determined by a control 75.

The manner of operation of the cutting device will now be described:

After the screws 66 for fixing the knife 4 in position have been loosened, the upper cylinder space of the mover 9 is acted on by pressure fluid which enters through the hose coupling 73. As a result, the piston 31, together with the rod 32, move into their low position. When this position has been reached, the knife 4 is oriented with respect to the cutting plate 5 so that the cutting edge 67 contacts the upper surface 68 of the cutting plate 5 over its full length. In this position the screws 66 are again tightened.

Then the lower cylinder space of the mover 9 is acted on by pressure fluid via the hose 74' and the hose coupling 73', as a result of which the piston 31 and the rod 32 move into their upper position. In this connection, the pin stops 37 enter into the recesses 21 of the displacement member 15 (FIGS. 1 and 2). By loosening the screw 52, the force-locked connection between the rod 32 and the block 47 is released when clamping bore 48 is opened. The special wrench mentioned above is then placed on the adjustment disk 24 in such a manner that its drivers engage in the slot 25 in the disk, whereby the displacement member 15 can be turned through an angle of rotation of up to 360°. This rotation is transmitted via the pin stops 37 to the piston 31 and thus to the rod 32. The rod 32 cannot be moved axially as a result of the aforementioned turning of the displacement member 15, since the action of pressure fluid on the lower cylinder space of the mover 9 which was introduced via the hose 74' and the hose coupling 73' continues, so that the piston 31 and the rod 32 remain as before in the upper position (FIG. 1). Even when the lower cylinder space is without pressure, the piston 31 and rod 32 remain in their upper position under the action of the compression spring 44.

Since the block 47 is secured against rotation by the guide means 57, it is moved positively in axial direction by rotation of the rod 32, which is momentarily movable only rotationally. Assuming the threaded pin 46 has a right-hand thread, then if the adjustment disk 24 and the displacement member 15 are turned counterclockwise, the block 47 and the knife 4 connected to it are displaced downward and therefore in the direction towards the cutting plate 5. In this connection, the previously aligned parallel relation of the cutting edge 67 and the upper surface 68 are retained.

The amount of the subsequent displacement A (see FIG. 1) of the cutting edge 67 with respect to the upper surface 68 depends on the pitch of the thread provided on the threaded pin 46. If the pitch is, for instance, 1.5 mm, then the maximum displacement is slightly less than this value. A displacement of 0.3 to 0.5 mm is therefore ordinarily obtained in any event. The scale on the graduated ring 29 serves as an aid for reproducibly adjusting the displacement of the cutting edge 67. Because of the stiff mounting of the displacement member 15 in the cover 11 and by the arrangement of the adjusting disk 24 depressed in the latter, unintended turning of the displacement member 15 is substantially excluded.

Thus, with the displacement described above of the cutting edge 67 with respect to the upper surface 68, which maintains their parallel relationship, the result is obtained that the cutting edge 67 can be adjusted to penetrate into the cutting plate 5 by a predetermined amount during the cutting process.

Then the screw 52 is then tightened again, as a result of which the force-locked connection between the rod 32 and the block 47 is again applied in the vicinity of the clamping bore 48.

Although the present invention has been described in relation to particular embodiments thereof, many other variations and modifications and other uses will become apparent to those skilled in the art. It is preferred, therefore, that the present invention be limited not by the specific disclosure herein, but only by the appended claims

What is claimed is:

1. An adjustable cutting device in a sewing machine, comprising a mover fastened to a frame of the sewing machine;

a rod depending from the mover and mounted so as to be moveable in a vertical direction by the mover;

a block connected at a lower portion of said rod, a moveable cutting member being fastened to the block, the moveable cutting member cooperating for cutting with a second cutting member on the frame;

the block being secured by guide means against rotation with respect to the frame; the block being connected to the rod; and by loosening the connection, the rod being moveable rotationally in response to rotation of a displacement member in the mover; and means for converting the rotational movement of the rod into movement of the block axially of the rod, whereby the rotation of the rod moves the movable cutting member vertically with respect to the second cutting member without changing a relative angle defined between them.

2. A sewing machine as in claim 1, wherein said means for converting the rotational movement of the rod into axial movement of the block includes a threaded interface between the rod and the block.

3. A sewing machine as in claim 2, wherein a cylindrical extension and a threaded pin are provided at the lower portion of the rod, and a clamping bore and a threaded hole are locatable in the block respectively adjacent thereto.

4. A sewing machine as in claim 3, wherein the guide means comprises a guide ledge on the block which is locatable so as to engage a guide slot which is on the frame.

5. A sewing machine as in claim 1, wherein the mover includes a pressure cylinder having within it a piston to which the rod is firmly attached; and upwardly-directed first engagement means provided at an upper part of the piston.

6. A sewing machine as in claim 5, wherein said pressure cylinder is double-acting.

7. A sewing machine as in claim 6, wherein said pressure cylinder is hydraulic.

8. A sewing machine as in claim 6, wherein said pressure cylinder is pneumatic.

9. A sewing machine as in claim 5, wherein the displacement member is mounted in the mover so as to be manually rotatable by force applied from outside the mower; and is attached to downwardly-directed second engagement means within the mover.

10. A sewing machine as in claim 9, wherein said first and second engagement means engage each other when said piston is in an uppermost position.

11. A sewing machine as in claim 10, further comprising a compression spring biasing said piston toward the uppermost position.

12. A sewing machine as in claim 10, wherein said first engagement means comprises at least one pin on the piston and said second engagement means comprises at least one corresponding recess in the mover for engaging the pin when the piston is in the uppermost position.

13. A sewing machine as in claim 1, wherein said moveable cutting member is a knife and said second cutting member is a cutting plate.

14. A sewing machine as in claim 13, wherein said cutting plate is stationary and mounted on the frame.

* * * * *